US012492501B2

(12) United States Patent
Reeves et al.

(10) Patent No.: US 12,492,501 B2
(45) Date of Patent: Dec. 9, 2025

(54) SYSTEMS AND METHODS FOR CALCULATING DRYING CYCLE TIMES IN A DRYER APPLIANCE

(71) Applicant: Haier US Appliance Solutions, Inc., Wilmington, DE (US)

(72) Inventors: Joshua Reeves, Louisville, KY (US); Jason Fuchs, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 620 days.

(21) Appl. No.: 17/969,062

(22) Filed: Oct. 19, 2022

(65) Prior Publication Data

US 2024/0133099 A1 Apr. 25, 2024
US 2024/0229318 A9 Jul. 11, 2024

(51) Int. Cl.

| | |
|---|---|
| ***D06F 34/05*** | (2020.01) |
| ***D06F 34/06*** | (2020.01) |
| ***D06F 34/18*** | (2020.01) |
| ***D06F 58/02*** | (2006.01) |
| ***D06F 58/38*** | (2020.01) |
| ***D06F 58/46*** | (2020.01) |
| *D06F 101/02* | (2020.01) |

(52) U.S. Cl.
CPC ..... *D06F 34/05* (2020.02); *D06F 34/06* (2020.02); *D06F 34/18* (2020.02); *D06F 58/02* (2013.01); *D06F 58/38* (2020.02); *D06F 58/46* (2020.02); *D06F 2101/02* (2020.02)

(58) Field of Classification Search
CPC ..... D06F 34/05; D06F 34/06; D06F 34/18; D06F 58/02; D06F 58/38; D06F 58/46; D06F 2101/02; D06F 2101/16; D06F 2103/02; D06F 2105/58
USPC ..... 34/318
See application file for complete search history.

(56) References Cited

U.S. PATENT DOCUMENTS

| | | | | |
|---|---|---|---|---|
| 9,027,258 | B2 | 5/2015 | Bellinger et al. | |
| 10,088,232 | B2 | 10/2018 | Prajescu | |
| 11,255,042 | B2 | 2/2022 | Choung et al. | |
| 2004/0118008 | A1 * | 6/2004 | Jeong | D06F 34/04 34/445 |

(Continued)

FOREIGN PATENT DOCUMENTS

| | | | | |
|---|---|---|---|---|
| KR | 20210120661 A | 10/2021 | | |
| WO | WO-2019095496 A1 * | 5/2019 | | D06F 58/46 |

*Primary Examiner* — John P Mccormack
(74) *Attorney, Agent, or Firm* — Dority & Manning, P.A.

(57) ABSTRACT

A dryer appliance includes a cabinet; a drum rotatably mounted within the cabinet, the drum defining a chamber for receipt of articles for drying; and a controller provided within the cabinet and operably connected with the drum, the controller including a wireless communication module, wherein the controller is configured to perform a drying operation. The drying operation includes obtaining one or more washer operating parameters from a washing machine appliance pertaining to a washing cycle; selecting a base drying cycle time from a plurality of base drying cycle times, each base drying cycle time of the plurality of base drying cycle times corresponding to a different combination of obtained washer operating parameters; calculating an initial cycle time estimate using the selected base drying cycle time; and initiating a drying cycle according to the initial cycle time estimate, initiating the drying cycle comprising displaying the initial cycle time estimate.

16 Claims, 5 Drawing Sheets

(56) References Cited

U.S. PATENT DOCUMENTS

| | | | | |
|---|---|---|---|---|
| 2005/0138835 | A1* | 6/2005 | Lyu | D06F 58/38 34/524 |
| 2020/0087847 | A1* | 3/2020 | Choung | D06F 58/30 |
| 2021/0207306 | A1* | 7/2021 | Koo | D06F 33/70 |
| 2022/0275556 | A1* | 9/2022 | Song | D06F 33/72 |

* cited by examiner

SYSTEMS AND METHODS FOR CALCULATING DRYING CYCLE TIMES IN A DRYER APPLIANCE

FIELD OF THE INVENTION

The present subject matter relates generally to laundry appliances, and more particularly, to dryer appliances and methods of improving dryer operation based on washing machine performance.

BACKGROUND OF THE INVENTION

Laundry appliances, such as washing machine appliances and dryer appliances, are commonly used to wash and dry, respectively, a load of clothes. Specifically, washing machine appliances generally include a wash tub for containing water or wash fluid and a wash basket rotatably mounted within the wash tub for receiving the load of clothes. These washing machines are typically equipped to operate in one or more modes or cycles, such as wash, rinse, and spin cycles. After the washing machine processes are complete, the load of clothes is moved over the to the dryer, which includes a cabinet with a drum rotatably mounted therein and a heating assembly that supplies heated air into a chamber of the drum, e.g., through a duct mounted to a back wall of the drum, to facilitate a drying process.

Notably, the overall performance of a laundry system may be improved by sharing cycle information and operating performance between the washer and dryer. For example, drying performance may be improved if the dryer is provided with details related to the wash cycle performed by the washing machine. However, the complex interrelationships between the various parameters monitored or controlled in each appliance, the user inputs, the wash load size or type, etc. may only be stored in complex data tables or in computationally intensive transfer functions or algorithms. Moreover, some parameters are not obtained by a connected dryer during some operations.

Accordingly, a laundry appliance system with improved data storage and interaction for improved performance would be useful. More specifically, a method of using operating parameters of the washing machine appliance and process to facilitate improved operation of a dryer appliance in a manner that allows for accurate cycle time estimates would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet; a drum rotatably mounted within the cabinet, the drum defining a chamber for receipt of articles for drying; and a controller provided within the cabinet and operably connected with the drum. The controller may include a wireless communication module. The controller may be configured to perform a drying operation. The drying operation may include obtaining one or more washer operating parameters from a washing machine appliance pertaining to a washing cycle; selecting a base drying cycle time from a plurality of base drying cycle times, each base drying cycle time of the plurality of base drying cycle times corresponding to a different combination of obtained washer operating parameters; calculating an initial cycle time estimate using the selected base drying cycle time; and initiating a drying cycle according to the initial cycle time estimate, initiating the drying cycle including displaying the initial cycle time estimate.

In another exemplary embodiment of the present disclosure, a method of operating a dryer appliance is provided. The method may include obtaining one or more washer operating parameters from a washing machine appliance pertaining to a washing cycle; selecting a base drying cycle time from a plurality of base drying cycle times, each base drying cycle time of the plurality of base drying cycle times corresponding to a different combination of obtained washer operating parameters; calculating an initial cycle time estimate using the selected base drying cycle time; and initiating a drying cycle according to the initial cycle time estimate, initiating the drying cycle including displaying the initial cycle time estimate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
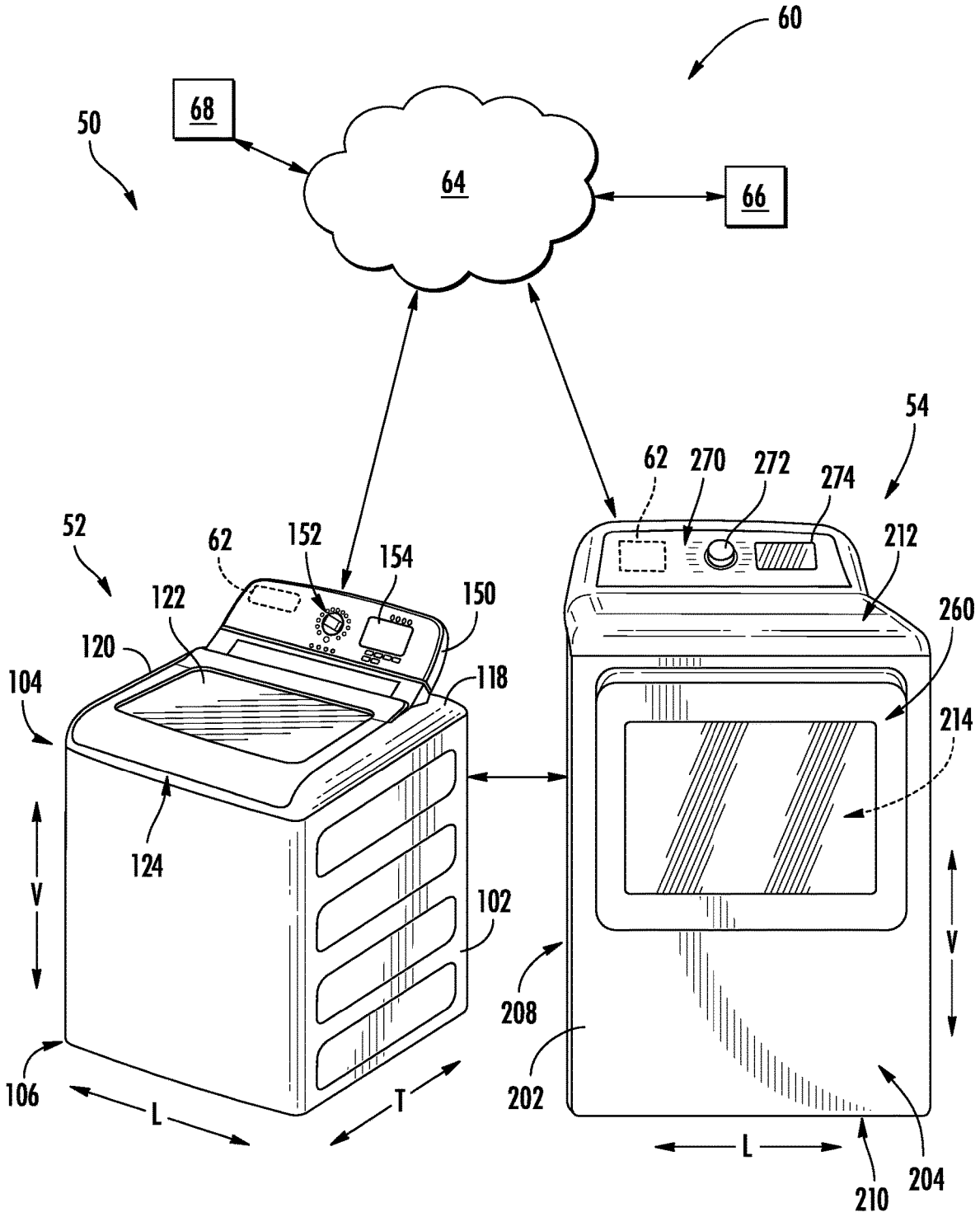
FIG. 1 provides a schematic representation of a laundry appliance system that includes a washing machine appliance, a dryer appliance, and an external communication system according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a laundry appliance system 50 according to exemplary embodiments of the present subject matter. As shown, laundry appliance system 50 generally includes a washing machine appliance 52 and a dryer appliance 54, for washing and drying clothes, respectively. Each of washing machine appliance 52 and dryer appliance 54 will be described below according to exemplary embodiments of the present subject matter. Specifically, these figures illustrate various views of washing machine 52 and dryer appliance 54 in order to facilitate discussion regarding the use and operation of laundry system 50. However, it should be appreciated that the specific appliance configurations illustrated and described are only exemplary, and the scope of the present subject matter is not limited to the configurations set forth herein. Furthermore, it should be appreciated that like reference numerals may be used to refer to the same or similar features between washing machine 52 and dryer appliance 54.

Referring still to FIG. 1, a schematic diagram of an external communication system 60 will be described according to an exemplary embodiment of the present subject matter. In general, external communication system 60 is configured for permitting interaction, data transfer, and other communications between and among washing machine 52, dryer appliance 54, and/or a user of such appliances. For example, this communication may be used to provide and receive operating parameters, cycle settings, performance characteristics, user preferences, or any other suitable information for improved performance of laundry system 50.

As illustrated, each of washing machine appliance 52 and dryer appliance 54 may include a controller 62 (described in more detail below). External communication system 60 permits controllers 62 of washer appliance 52 and dryer appliance 54 to communicate with external devices either directly or through a network 64. For example, a consumer may use a consumer device 66 to communicate directly with washing machine 52 and/or dryer appliance 54. Alternatively, these appliances may include user interfaces for receiving such input (described below). For example, consumer devices 66 may be in direct or indirect communication with washing machine 52 and dryer appliance 54, e.g., directly through a local area network (LAN), Wi-Fi, Bluetooth, Zigbee, etc. or indirectly through network 64. In general, consumer device 66 may be any suitable device for providing and/or receiving communications or commands from a user. In this regard, consumer device 66 may include, for example, a personal phone, a tablet, a laptop computer, or another mobile device.

In addition, a remote server 68 may be in communication with washing machine 52, dryer appliance 54, and/or consumer device 66 through network 64. In this regard, for example, remote server 68 may be a cloud-based server 68, and is thus located at a distant location, such as in a separate state, country, etc. In general, communication between the remote server 68 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 64 can be any type of communication network. For example, network 64 can include one or more of a wireless network, a wired network, a personal area network, a local area network, a wide area network, the internet, a cellular network, etc. According to an exemplary embodiment, consumer device 66 may communicate with a remote server 68 over network 64, such as the internet, to provide user inputs, transfer operating parameters or performance characteristics, etc. In addition, consumer device 66 and remote server 68 may communicate with washing machine 52 and dryer appliance 54 to communicate similar information.

External communication system 60 is described herein according to an exemplary embodiment of the present subject matter. However, it should be appreciated that the exemplary functions and configurations of external communication system 60 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Figure 2:
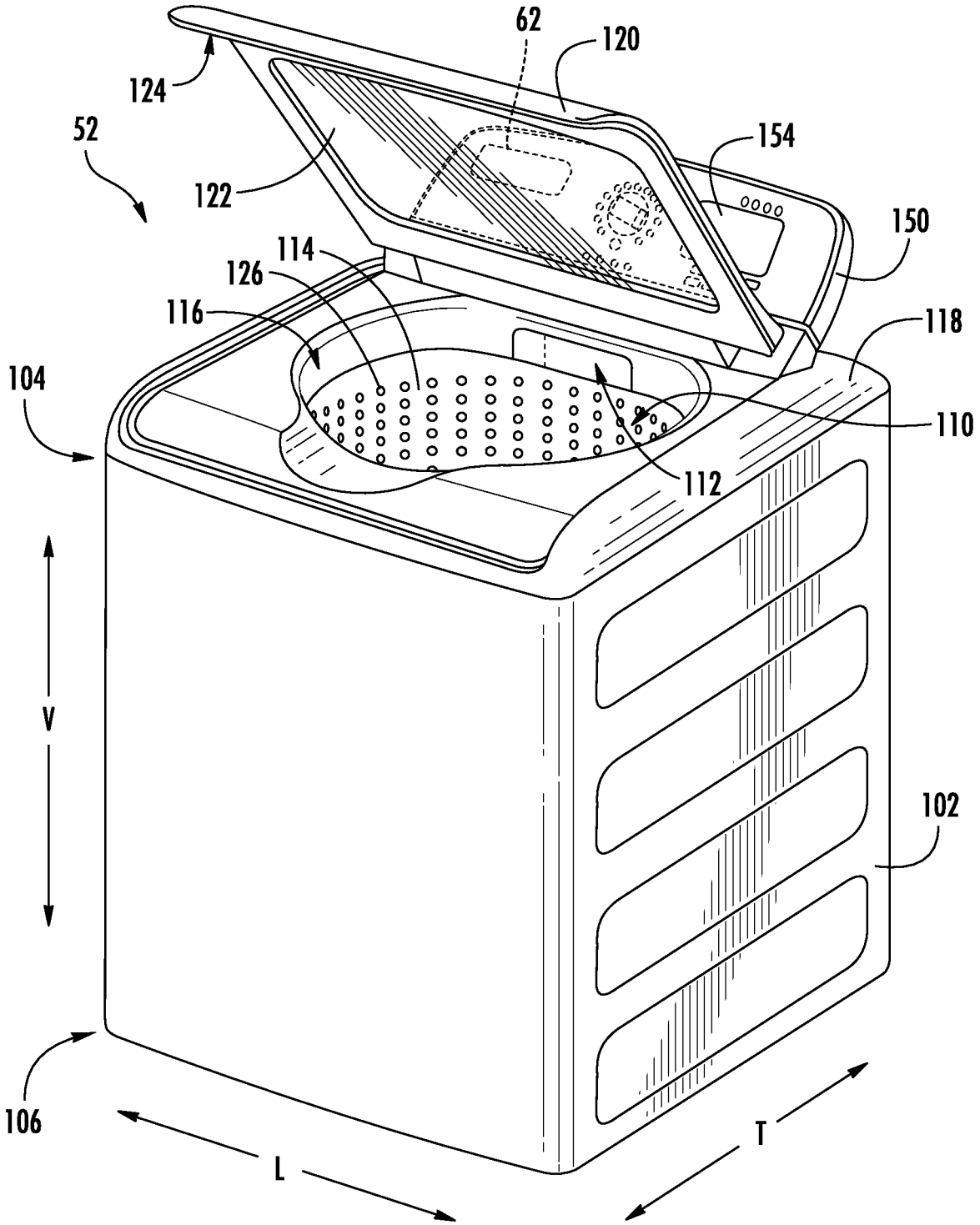
FIG. 2 provides a perspective view of the exemplary washing machine appliance of FIG. 1 with the door of the exemplary washing machine appliance shown in an open position.
Figure 3:
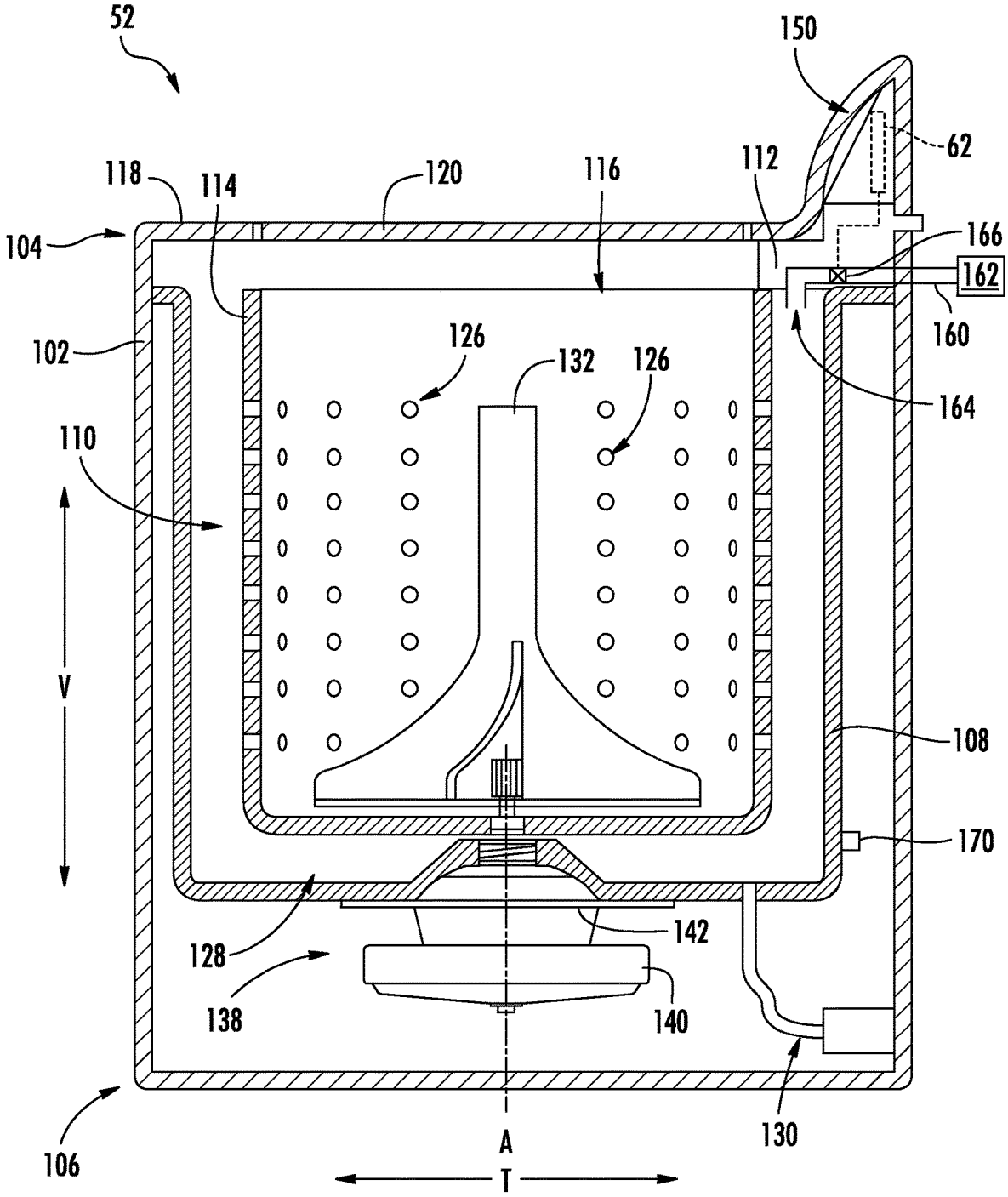
FIG. 3 provides a side cross-sectional view of the exemplary washing machine appliance of FIG. 1.

Referring now also to FIGS. 2 and 3, washing machine appliance 52 will be described according to an exemplary embodiment of the present subject matter. Specifically, these figures illustrate an exemplary embodiment of a vertical axis washing machine appliance 52. Specifically, FIGS. 1 and 2 illustrate perspective views of washing machine appliance 52 in a closed and an open position, respectively. FIG. 3 provides a side cross-sectional view of washing machine appliance 52. Washing machine appliance 52 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 52, it should be appreciated that vertical axis washing machine appliance 52 is provided by way of example only. It will be understood that aspects of the present subject matter may be used in any other suitable washing machine appliance, such as a horizontal axis washing machine appliance. Indeed, modifications and variations may be made to washing machine appliance 52, including different configurations, different appearances, and/or different features while remaining within the scope of the present subject matter.

Washing machine appliance 52 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 52 further includes a primary dispenser 112 (FIG. 2) for dispensing wash fluid into wash tub 108. The term "wash fluid" refers to a liquid used for washing and/or rinsing articles during an operating cycle and may include any combination of water, detergent, fabric softener, bleach, and other wash additives or treatments.

In addition, washing machine appliance 52 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 52 is generally referred to as a "vertical axis" or "top load" washing machine appliance 52. However, it should be appreciated that aspects of the present subject matter may be used within the context of a horizontal axis or front load washing machine appliance as well. As used herein, terms of approximation, such as "approximately," "substantially," or "about," refer to being within a ten percent margin of error.

As illustrated, cabinet 102 of washing machine appliance 52 has a top panel 118. Top panel 118 defines an opening (FIG. 2) that coincides with opening 116 of wash basket 114 to permit a user access to wash basket 114. Washing machine appliance 52 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 52. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 52 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 52, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 52 includes a drive assembly 138 in mechanical communication with wash basket 114 to selectively rotate wash basket 114 (e.g., during an agitation or a rinse cycle of washing machine appliance 52). In addition, drive assembly 138 may also be in mechanical communication with agitation element 132. In this manner, drive assembly 138 may be configured for selectively rotating or oscillating wash basket 114 and/or agitation element 132 during various operating cycles of washing machine appliance 52.

More specifically, drive assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, drive assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a count-down timer, and/or other items of interest to appliance users regarding operation.

Operation of washing machine appliance 52 is controlled by a controller or processing device 62 that is operatively coupled to control panel 150 for user manipulation to select washing machine cycles and features. In response to user manipulation of control panel 150, controller 62 operates the various components of washing machine appliance 52 to execute selected machine cycles and features. According to an exemplary embodiment, controller 62 may include a memory and microprocessor, such as a general or special purpose microprocessor operable to execute programming instructions or micro-control code associated with methods described herein. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 52 may be in communication with controller 62 via one or more signal lines or shared communication busses.

During operation of washing machine appliance 52, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 52 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

More specifically, referring again to FIG. 3, a water fill process will be described according to an exemplary embodiment. As illustrated, washing machine appliance 52 includes a water supply conduit 160 that provides fluid communication between a water supply source 162 (such as a municipal water supply) and a discharge nozzle 164 for directing a flow of water into wash chamber 110. In addition, washing machine appliance 52 includes a water fill valve or water control valve 166 which is operably coupled to water supply conduit 160 and communicatively coupled to controller 62. In this manner, controller 62 may regulate the operation of water control valve 166 to regulate the amount of water within wash tub 108. In addition, washing machine appliance 52 may include one or more pressure sensors 170 for detecting the amount of water and or clothes within wash tub 108. For example, pressure sensor 170 may be operably coupled to a side of tub 108 for detecting the weight of wash tub 108, which controller 62 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. After articles disposed in wash basket 114 are cleaned and/or washed, the user can remove the articles from wash basket 114, e.g., by reaching into wash basket 114 through opening 116.

Figure 4:
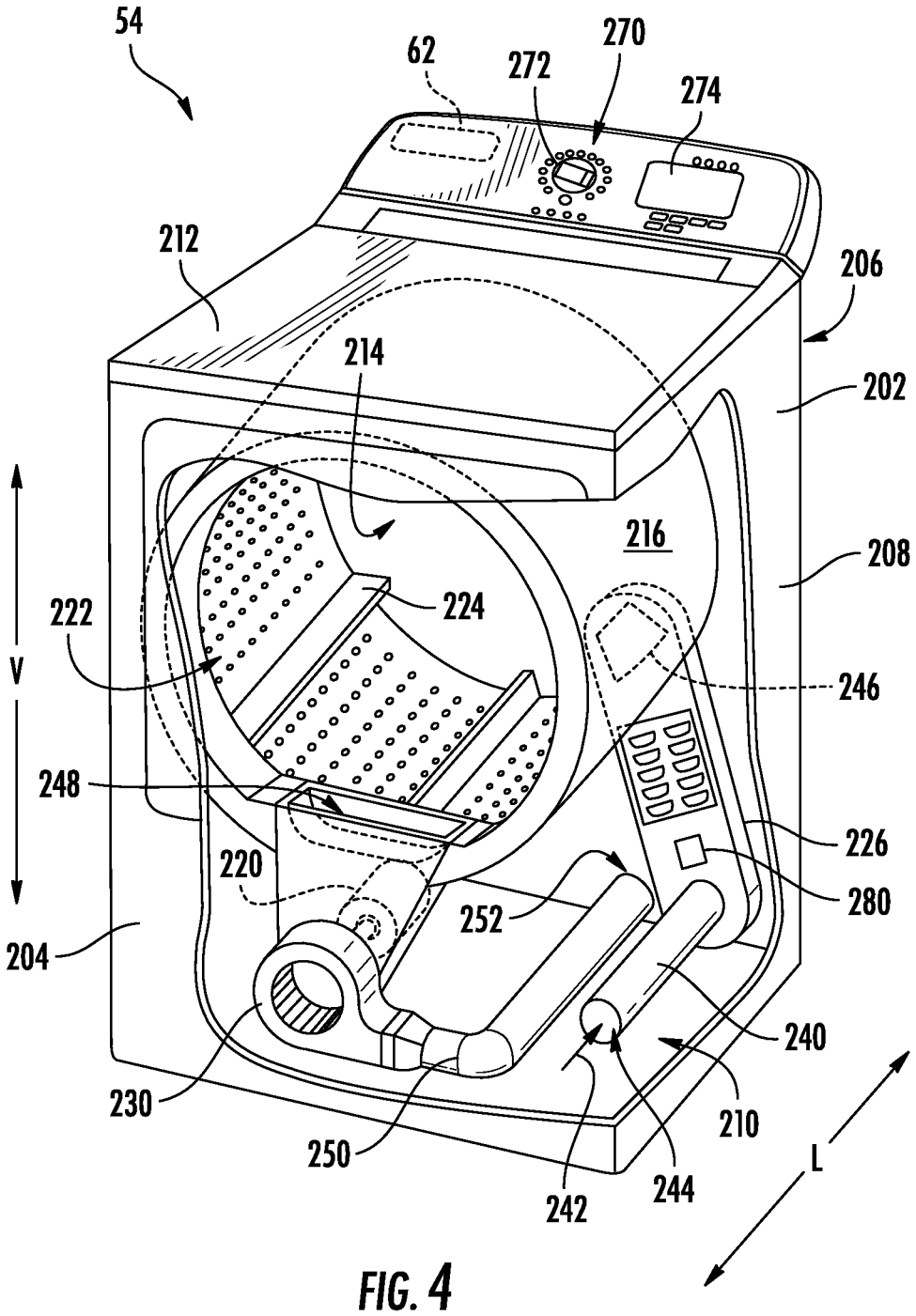
FIG. 4 provides a perspective view of the exemplary dryer appliance of FIG. 1 with portions of a cabinet of the dryer appliance removed to reveal certain components of the dryer appliance.

Referring now to FIG. 4, a perspective view of dryer appliance 54 is provided with a portion of a cabinet or housing 202 of dryer appliance 54 removed in order to show certain components of dryer appliance 54. While described in the context of a specific embodiment of dryer appliance 54, using the teachings disclosed herein it will be understood that dryer appliance 54 is provided by way of example only. Other dryer appliances having different appearances and different features may also be utilized with the present subject matter as well. Dryer appliance 54 defines a vertical direction V, a lateral direction L, and a transverse direction T. The vertical direction V, lateral direction L, and transverse direction T are mutually perpendicular and form an orthogonal direction system.

Cabinet 202 includes a front panel 204, a rear panel 206, a pair of side panels 208 spaced apart from each other by front and rear panels 204 and 206, a bottom panel 210, and a top cover 212. Within cabinet 202 is a drum or container 216 mounted for rotation about a substantially horizontal axis, e.g., that is parallel or substantially parallel to the lateral direction L. Drum 216 defines a chamber 214 for receipt of articles, e.g., clothing, linen, etc., for drying. Drum 216 extends between a front portion and a back portion, e.g., along the lateral direction L.

A motor 220 is configured for rotating drum 216 about the horizontal axis, e.g., via a pulley and a belt (not shown). Drum 216 is generally cylindrical in shape, having an outer cylindrical wall or cylinder and a front flange or wall that defines an entry 222 of drum 216, e.g., at the front portion of drum 216, for loading and unloading of articles into and out of chamber 214 of drum 216. A plurality of tumbling ribs 224 are provided within chamber 214 of drum 216 to lift articles therein and then allow such articles to tumble back to a bottom of drum 216 as drum 216 rotates. Drum 216 also includes a back or rear wall, e.g., such that drum 216 is rotatable on its rear wall as will be understood by those skilled in the art. A duct 226 is mounted to the rear wall of drum 216 and receives heated air that has been heated by a heating assembly or system 240.

Motor 220 is also in mechanical communication with an air handler 230 such that motor 220 rotates air handler 230, e.g., a centrifugal fan. Air handler 230 is configured for drawing air through chamber 214 of drum 216, e.g., in order to dry articles located therein as discussed in greater detail below. In alternative exemplary embodiments, dryer appliance 54 may include an additional motor (not shown) for rotating air handler 230 independently of drum 216.

Drum 216 is configured to receive heated air that has been heated by a heating assembly 240, e.g., in order to dry damp articles disposed within chamber 214 of drum 216. Heating assembly 240 includes a heating element (not shown), such as a gas burner or an electrical resistance heating element, for heating air. As discussed above, during operation of dryer appliance 54, motor 220 rotates drum 216 and air handler 230 such that air handler 230 draws air through chamber 214 of drum 216 when motor 220 rotates. In particular, ambient air (identified herein generally by reference numeral 242) enters heating assembly 240 via an entrance 244 due to air handler 230 urging such ambient air into entrance 244. Such ambient air is heated within heating assembly 240 and exits heating assembly 240 as heated air 242. Air handler 230 draws such heated air through duct 226 to drum 216. The heated air enters drum 216 through an outlet 246 of duct 226 positioned at the rear wall of drum 216.

Within chamber 214, the heated air can accumulate moisture, e.g., from damp articles disposed within chamber 214. In turn, air handler 230 draws humid air through a trap duct 248 which contains a screen filter (not shown) which traps lint particles. Such humid air then passes through trap duct 248 and air handler 230 before entering an exhaust conduit 250. From exhaust conduit 250, such humid air passes out of dryer appliance 54 through a vent 252 defined by cabinet 202. After the clothing articles have been dried, they are removed from the drum 216 via entry 222. A door 260 provides for closing or accessing drum 216 through entry 222.

A user interface panel 270 is positioned on a cabinet backsplash and includes a cycle selector knob 272 that is in communication with a processing device or controller (such as a controller 62). Signals generated in controller 62 operate motor 220, air hander, 230, and heating assembly 240 in response to the position of selector knobs 272. User interface panel 270 may further conclude additional indicators, a display screen, a touch screen interface 174, etc. for providing information to a user of the dryer appliance 54 and receiving suitable operational feedback. Alternatively, a touch screen type interface, knobs, sliders, buttons, speech recognition, etc., mounted to cabinet backsplash or at any other suitable location to permit a user to input control commands for dryer appliance 54 and/or controller 62.

Controller 62 may include memory and one or more processing devices such as microprocessors, CPUs or the like, such as general or special purpose microprocessors operable to execute programming instructions or micro-control code associated with operation of dryer appliance 54. The memory can represent random access memory such as DRAM, or read only memory such as ROM or FLASH. The processor executes programming instructions stored in the memory. The memory may be a separate component from the processor or may be included onboard within the processor. Alternatively, controller 62 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In general, controller 62 is in operative communication with various components of dryer appliance 54. In particular, controller 62 is in operative communication with motor 220 and heating assembly 240. Thus, upon receiving an activation signal from cycle selector knob 272, controller 62 can activate motor 220 to rotate drum 216 and air handler 230. Controller 62 can also activate heating assembly 240 in order to generate heated air for drum 216, e.g., in the manner described above.

Controller 62 is also in communication with a thermal or temperature sensor 280, e.g., a thermocouple or thermistor. Temperature sensor 280 is configured for measuring a temperature of heated air within duct 226. Temperature sensor 280 can be positioned at any suitable location within dryer appliance 54. For example, temperature sensor 280 may be positioned within or on duct 226. Controller 62 can receive a signal from temperature sensor 280 that corresponds to a temperature measurement of heated air within duct 226, e.g., a temperature measurement of heated air exiting duct 226 at outlet 246.

Now that the construction of system 50, washing machine 52, dryer appliance 54, and external communication system 60 have been presented according to exemplary embodiments, an exemplary method 300 of operating a system of laundry appliances will be described. Although the discussion below refers to the exemplary method 300 of operating system 50 to improve the operation of dryer appliance 54, one skilled in the art will appreciate that the exemplary method 300 is applicable to the monitoring and control of any suitable system of laundry appliances. In exemplary embodiments, the various method steps as disclosed herein may be performed by controllers 62, remote server 68, and/or a separate, dedicated controller.

Advantageously, a plurality of potential variables may be obtained for use in calculating initial dryer cycle time estimates. For instance, when approximating a time to complete a cycle, a user may be able to plan according to an accurate time to complete the cycle, including initiating another washing load, performing errands, or the like. Moreover, a repeated requirement for certain extreme base variables may be an indication of an issue which would require service or repair.

Figure 5:
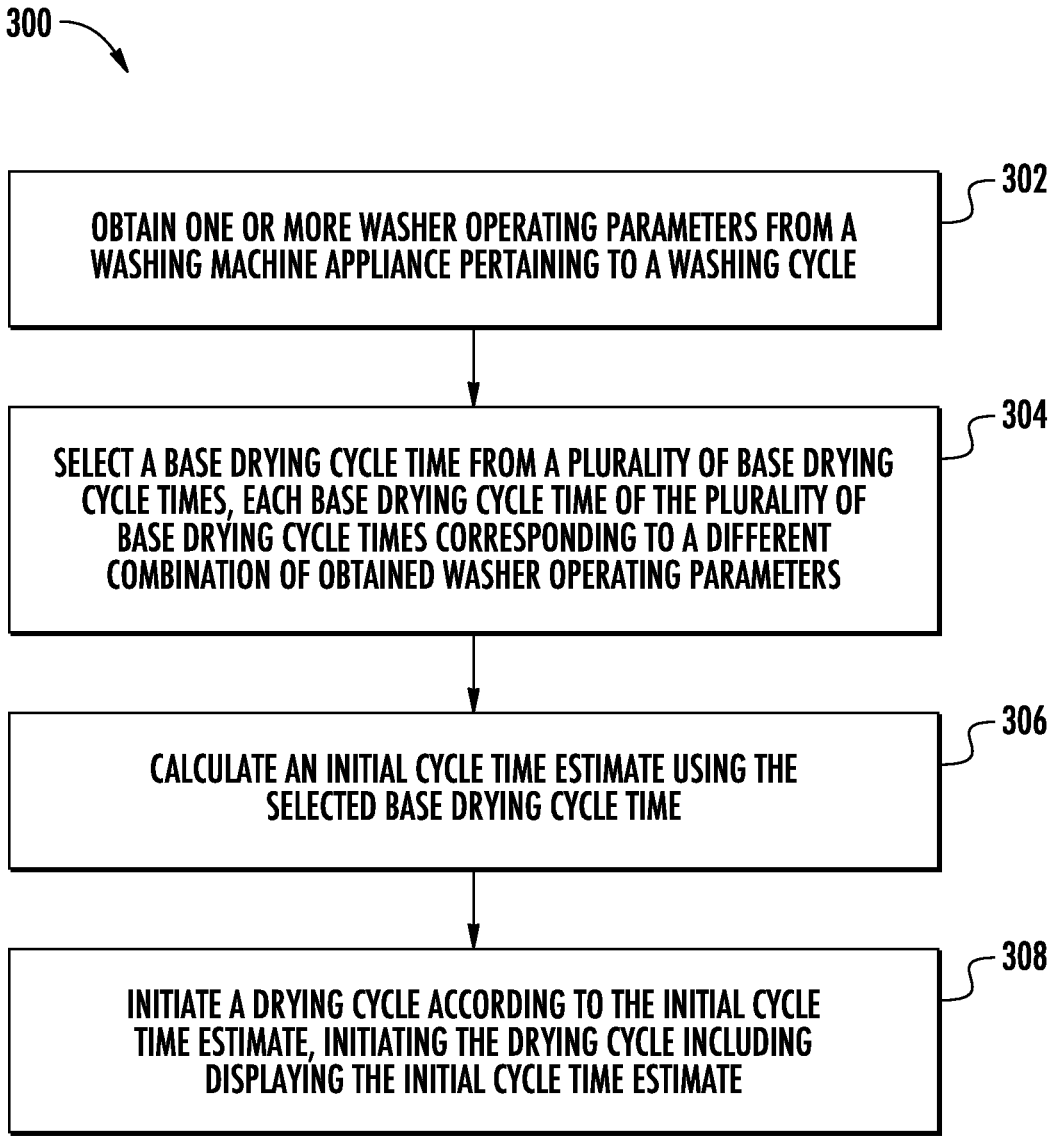
FIG. 5 provides a method of operating a dryer appliance according to an exemplary embodiment of the present subject matter.

Turning especially to FIG. 5, at step 302, method 300 may include obtaining one or more washer operating parameters from a washing machine appliance pertaining to a washing cycle. In detail, a dryer appliance (e.g., dryer appliance 54) may be operably connected (or linked) to a washing machine appliance (e.g., washing machine 52). The connection between the washing machine and the dryer may be a wired connection, a wireless connection, or a combination of wired and wireless connections. Accordingly, the washing machine and the dryer may communicate with each other (e.g., to exchange information between each other).

The dryer may initiate a connection with the washing machine (or vice versa). For instance, the dryer may be powered on (e.g., by a user) to initiate a drying cycle. The dryer may then search for an available connection with a washing machine. According to some embodiments, upon completing a washing operation, the washing machine searches for an available dryer with which to establish a connection. Accordingly, the washing machine and the dryer may be linked (e.g., via the operable connection). For example, the washing machine and the dryer are each in communication with a cloud connection (e.g., cloud-based remote server 68) through which data is transferred between the two appliances.

A plurality of washer operating parameters may be shared between the two appliances (e.g., from the washing machine to the dryer). The operating parameters may pertain to a recently completed washing cycle. For instance, as a current washing cycle is completed, a controller of the washing machine may determine or store the plurality of washing parameters to be transferred to the dryer. The plurality of washer operating parameters may pertain to or include options selected by a user and implemented into the washing cycle (e.g., spin level or speed, water amount, cycle style, load size, etc.) or may pertain to characteristics of the washing load as determined by one or more sensors provided within the washing machine (e.g., amount of retained moisture, a wet-load weight, realized spin speed, etc.). Thus, the washer operating parameters may include at least one of a load type, a load weight, or a remaining moisture content (e.g., after completion of the washing cycle).

At step 304, method 300 may include selecting a base drying cycle time (DCT) from a plurality of base DCTs based on the one or more washer operating parameters. In detail, the dryer appliance (or system 50) may store a plurality of different base DCTs. Each base DCT may correspond to a different combination of the obtained washer operating parameters. For instance, the washing machine may only be able to determine select washer operating parameters after the conclusion of the washing cycle (e.g., one or two of the remaining moisture content, the load size, or the load weight). In determining (e.g., selecting) the appropriate base DCT, the method 300 may include determining which of the washer operating parameters was or were obtained by the dryer appliance.

The base DCT may be used in calculating an initial cycle time estimate (described below) for determining and displaying the estimated time to complete a drying cycle. A plurality of factors may selectively adjust the base DCT. For instance, one or more of the factors may be obtained (e.g., at step 302) from the connected washing machine. For instance, a first base DCT may correspond to a first set of washer operating parameters. The first set of washer parameters may include the load size of the laundry load, the remaining moisture content of the laundry load (e.g., after completion of the washing cycle), and the load type of the laundry load. Accordingly, the first base DCT may incorporate three or more known washer operating parameters.

Similarly, a second base DCT may correspond to a second set of washer operating parameters. The second set of washer operating parameters may be different from the first set of washer operating parameters. For instance, the second set of washer operating parameters may include only the remaining moisture level of the laundry load (e.g., after completion of the washing cycle), while lacking the load type of the laundry load. Due to a lack of information (e.g., washer operating parameters) delivered by the washing machine, a lack of a connection between the washing machine and the dryer, or a malfunction between the washing machine and the dryer, certain washer operating parameters may not be obtained by the dryer (e.g., such as laundry load size, laundry load type, etc.). Thus, the second base DCT may account for the lack of knowledge of the missing washer operating parameters and the second base DCT may be different from the first base DCT. As would be understood, any reasonable number of different base DCTs may be provided and stored. For instance, a plurality of base DCTs corresponding to each variation of known and unknown washer operating parameters may be provided in a look-up table (e.g., on a memory within the dryer).

The plurality of base DCTs may be calculated or determined based on additional operating parameters. For instance, each base DCT may also incorporate a plurality of dryer operating parameters. The dryer operating parameters may include an airflow condition within the dryer appliance, a heater power or efficiency within the dryer appliance (e.g., within an air circulation system comprising a lint trap), or the like. In detail, the airflow condition within the dryer appliance may include a total amount of air flowing through the air circulation system (e.g., as determined by a recorded air pressure within the air circulation system), a status of the lint trap (e.g., clogged, partially clogged, clean), a power draw of an air handler or fan (e.g., in wattage), a rotational speed of the air handler, or the like. The airflow condition or conditions may be determined according to data measured by one or more sensors provided within the dryer. Additionally or alternatively, the air flow condition or conditions may be extrapolated from historical drying cycles (e.g., historical drying times in recently performed cycles). Similarly, the heater power or efficiency may include a power draw of the heater or heating element within the air circulation system, a heat level selection prior to the initiation of the drying cycle (e.g., as selected by a user), or the like. Accordingly, each of the airflow condition and the heater power or efficiency may be obtained through empirical data gathered by one or more sensors.

Each base DCT may be dynamically adaptable based on previously performed drying cycles. In detail, a record may be kept of each drying cycle performed under certain known conditions or operating parameters (e.g., washer operating parameters). A controller (e.g., of the dryer) may track the elapsed drying times of historical drying cycles using specific base DCTs (i.e., keeping data for each drying cycle performed incorporating the first stored base DCT, each drying cycle performed incorporating the second stored base DCT, etc.). For example, the drying cycles performed may be sensor dry cycles, utilizing one or more moisture sensors to determine when the laundry load has reached a desired dryness. As actual drying times change through repeat drying cycles (e.g., as determined via the one or more moisture sensors), the respective base DCT may be adjusted to better anticipate a total drying time under the respective operating conditions.

Thus, in selecting the base DCT from the plurality of base DCTs, the method 300 may include matching the obtained washer operating parameters with the corresponding base DCT. For instance, the plurality of DCTs may be stored in a look-up table and arranged according to known operating parameters (e.g., washer operating parameters and dryer operating parameters). After the washing cycle has completed and the select washer operating parameters have been obtained by the dryer, the dryer may receive one or more inputs from a user pertaining to the drying cycle to be performed. The received and selected operating parameters may then be matched with the corresponding base DCT.

At step 306, method 300 may include calculating an initial cycle time estimate using the selected base DCT. As mentioned above, an initial estimate of the time required to complete the drying cycle may be calculated before initiating the drying cycle. The initial cycle time estimate (CTE) may incorporate or be based on the selected base DCT. Additionally or alternatively, the initial CTE may be based on a dryness factor. In detail, the dryness factor may be an option selected by the user prior to initiating the drying cycle. According to some embodiments, the dryness factor is one of Very Dry, Dry, Less Dry, Damp, or Air Fluff. Thus, the initial CTE may incorporate the user selected dryness level with the selected base DCT.

The initial CTE may include a temperature factor. The temperature factor may be (or otherwise correspond to) a user selected temperature for the drying cycle. For instance, the dryer appliance may include a plurality of heat options for the drying cycle. The plurality of heat options may include a high heat, a medium heat, a low heat, and no heat. Thus, the dryer appliance may determine the heat level selected by the user after obtaining the washer operating parameters. Each of the dryness factor and the temperature may adjust the initial CTE in conjunction with the selected base DCT.

The initial CTE may include additional factors, such as cycle enhancement factors. In detail, the cycle enhancement factors may be additional factors or selections chosen at the initiation of the drying cycle (e.g., by a user). The cycle enhancement factors may include a sanitization factor, a detangle factor, a dewrinkle factor, a static-reduction factor, or the like. For instance, the user may choose to add one or more of the additional factors to the chosen drying cycle. For one example, in calculating the initial CTE where a sanitization factor is selected, additional heat and/or additional time is factored into the initial CTE to ensure the proper execution of sanitization.

Additionally or alternatively, a plurality washer operating parameters may be incorporated into calculating the initial CTE. For instance, when the washing machine and dryer are operably connected, the dryer may obtain additional washer operating parameters. The additional washer operating parameters may include a washer load size factor and a washer spin factor. The washer load size factor may be the same as the laundry load size (e.g., as determined within the washing machine). Thus, for example, when the washer load size factor is obtained by the dryer, the corresponding base DCT is chosen where the laundry load size is known.

The washer spin factor may correspond to a spin speed realized by the washing machine. For instance, the washing machine may obtain data pertaining to the spin phase or phases performed during the washing cycle (e.g., such as spin rate, spin speed, etc.). This data may include a selected spin speed, an actual realized spin speed, or a combination of each. This data may then be obtained by the dryer (e.g., as part of the operable connection). Accordingly, the corresponding base DCT may be chosen to accommodate for the washer spin factor. Advantageously, an accurate initial CTE may be calculated according to the known washer operating parameters and dryer operating parameters by selecting the corresponding base DCT prior to performing the calculation. By storing a plurality of base DCTs (e.g., dynamically adaptable base DCTs), an accurate calculation may notably be made for any scenario of a laundry load.

At step 308, method 300 may include initiating a drying cycle according to the initial cycle time estimate. Prior to initiating the drying cycle, the initial CTE may be displayed (e.g., presented to the user). For instance, the initial CTE may be displayed on a user interface of the dryer appliance. Additionally or alternatively, the initial CTE may be transmitted to a mobile device of the user (e.g., within a mobile application). The initial CTE may thus inform the user as to an estimated time to complete the drying cycle. The drying cycle may then be initiated. In some embodiments, the drying cycle is initiated by the user (e.g., via a button press, voice command, gesture, or the like). In still other embodiments, the drying cycle is initiated automatically upon determination of the initial CTE.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for receipt of articles for drying; and a controller provided within the cabinet and operably connected with the drum, the controller comprising a wireless communication module, wherein the controller is configured to perform a drying operation, the drying operation comprising:

obtaining one or more washer operating parameters from a washing machine appliance pertaining to a washing cycle;

selecting a base drying cycle time from a plurality of base drying cycle times, each base drying cycle time of the plurality of base drying cycle times corresponding to a different combination of obtained washer operating parameters, wherein each of the plurality of base drying cycle times is based on a plurality of dryer operating parameters;

calculating an initial cycle time estimate using the selected base drying cycle time; and initiating a drying cycle according to the initial cycle time estimate, initiating the drying cycle comprising displaying the initial cycle time estimate.

2. The dryer appliance of claim 1, wherein the washing machine appliance is operably connected to the dryer appliance.

3. The dryer appliance of claim 1, wherein the washer operating parameters comprise at least one of a load type, a load weight, or a remaining moisture content.

4. The dryer appliance of claim 1, wherein the plurality of dryer operating parameters comprises an airflow condition within the dryer appliance.

5. The dryer appliance of claim 1, wherein the plurality of dryer operating parameters comprises a heater power of a heater provided within the dryer.

6. The dryer appliance of claim 1, wherein the calculated initial cycle time estimate is based on:

a dryness level of the articles for drying, the dryness level being input by a user.

7. The dryer appliance of claim 1, wherein selecting the base drying cycle time from the plurality of base drying cycle times comprises:

matching the obtained washer operating parameters with a corresponding base drying cycle time.

8. The dryer appliance of claim 1, wherein each base drying cycle time of the plurality of base drying cycle times is dynamically adaptable based on previously performed drying cycles.

9. A method of operating a dryer appliance, the method comprising:

obtaining one or more washer operating parameters from a washing machine appliance pertaining to a washing cycle;

selecting a base drying cycle time from a plurality of base drying cycle times, each base drying cycle time of the plurality of base drying cycle times corresponding to a different combination of obtained washer operating parameters, wherein each of the plurality of base drying cycle times is based on a plurality of dryer operating parameters;

calculating an initial cycle time estimate using the selected base drying cycle time; and initiating a drying cycle according to the initial cycle time estimate, initiating the drying cycle comprising displaying the initial cycle time estimate.

10. The method of claim 9, wherein the washing machine appliance is operably connected to the dryer appliance.

11. The method of claim 9, wherein the washer operating parameters comprise at least one of a load type, a load weight, or a remaining moisture content.

12. The method of claim 9, wherein the plurality of dryer operating parameters comprises an airflow condition within the dryer appliance.

13. The method of claim 9, wherein the plurality of dryer operating parameters comprises a heater power of a heater provided within the dryer.

14. The method of claim 9, wherein the calculated initial cycle time estimate is based on:

a dryness level of the articles for drying, the dryness level being input by a user.

15. The method of claim 9, wherein selecting the base drying cycle time from the plurality of base drying cycle times comprises:

matching the obtained washer operating parameters with a corresponding base drying cycle time.

16. The method of claim 9, wherein each base drying cycle time of the plurality of base drying cycle times is dynamically adaptable based on previously performed drying cycles.

* * * * *